US005997254A

United States Patent [19]

Tosaki

[11] Patent Number: 5,997,254

[45] Date of Patent: Dec. 7, 1999

[54] AIR BLOWER FOR A REFRIGERATION UNIT

[75] Inventor: Junichi Tosaki, Aichi, Japan

[73] Assignee: Hoshizaki Denki Kabushiki Kaisha, Tokoake, Japan

[21] Appl. No.: 09/013,997

[22] Filed: Jan. 27, 1998

[30] Foreign Application Priority Data

Jan. 31, 1997 [JP] Japan ..... 9-033335

[51] Int. Cl.[6] ..... B63H 1/00; B64C 11/00; F01D 25/00

[52] U.S. Cl. ..... 416/247 R

[58] Field of Search ..... 416/244 R, 247 R

[56] References Cited

U.S. PATENT DOCUMENTS 1,742,366 1/1930 Nagao ..... 416/247 R X 5,613,833 3/1997 Wolfe et al. ..... 416/247 R X 5,671,610 9/1997 Shin ..... 416/247 R X

FOREIGN PATENT DOCUMENTS 2-81380 6/1990 Japan .

*Primary Examiner*—John E. Ryznic

*Attorney, Agent, or Firm*—Morgan, Lewis & Bockius LLP

[57] ABSTRACT

An attaching plate is fixed to a cooling air duct in a refrigerator. A fan motor for supplying cooling air, is downwardly directed and is attached to the attaching plate. A fan cover is attached to the cooling air duct and below the fan motor. A bottom plate portion having a recess is disposed in the fan cover so as to be opposed to the tip end of the fan rotation shaft which is downwardly projected from a fan.

9 Claims, 4 Drawing Sheets

AIR BLOWER FOR A REFRIGERATION UNIT

BACKGROUND OF THE INVENTION

The invention relates to an air blower for a refrigerator, a freezer, or the like, and particularly to a mechanism for preventing a fan used in a refrigerator or freezer from being damaged.

As shown in FIG. 1, in a prior art refrigerator or freezer a machine room 2 is disposed above a main unit 1. An air blower of the prior art, which supplies air cooled by an evaporator 3 to the interior of the main unit 1, is configured in the following manner. As shown in FIGS. 2 and 3, a fan motor 6 is downwardly directed and is attached to an attaching plate 5 fixed to a cooling air duct 4. A fan cover 7 in which the whole face has a grill-like shape is attached to the cooling air duct 4 at a position below the fan motor 6, and a tip end 9 of a fan rotation shaft, which is downwardly projected from a fan 8, is opposed to the fan cover 7.

When the fan motor 6 is used for a long time, the attaching plate 5 may become deformed by vibrations and the like, as shown in FIG. 4. This causes the fan motor 6 to drop from the original attachment position. When this happens, the tip end 9 of the fan rotation shaft may pass through an opening 7' of the grill of the fan cover 7 and the position of the fan 8 may be lowered to contact the inner face of the fan cover 7. When the fan 8 contacts the inner face of the fan cover 7, the fan 8 and the fan cover 7 both are damaged because of the rotation of the fan 8 and the load given by the fan motor 6. Moreover, the fan motor 6 may break because of an extra load imposed on the fan motor 6.

In a fan guard for a refrigerator disclosed in Japanese Utility Model Unexamined Publication No. Hei. 2-81380, the center portion of the fan guard, which is opposed to the rotation shaft of the fan, is closed. Since the fan rotation shaft horizontally elongates, there is little danger that the fan deviates toward the fan guard as a result of a long term use of the refrigerator. If the fan is downwardly directed and drops from the attachment position toward the fan guard, the fan immediately contracts the fan guard because the fan is disposed below the tip end of the fan rotation shaft. This causes the same problems as those of the above-described air blower of the prior art.

SUMMARY OF THE INVENTION

It is an object of the invention to provide an air blower for a refrigerator, a freezer, or the like in which, even when a downwardly-directed fan motor drops from its attachment position, a fan and a fan cover are not damaged as a result of the drop.

In order to attain the object, in the air blower for a refrigerator or the like of the invention, the air blower includes:

a fan;

a fan motor downwardly directed and having a fan rotation shaft to which the fan is attached, a tip end of the fan rotation shaft being downwardly projected from the fan; and a fan cover attached below the fan motor, the fan cover being provided with a bottom plate portion formed at a position confronted with the tip end of the fan rotation shaft for keeping a gap between the fan and an inner face of the fan cover by contacting with the tip end of the fan rotation shaft, when the fan motor drops accidentally.

In the above-mentioned air blower for a refrigerator or the like, a recess is preferably formed in the bottom plate portion at a position opposed to the tip end of the fan rotation shaft such that the tip end of the fan rotation shaft is received into the recess when the fan motor drops.

Further, in the above-mentioned air blower for a refrigerator or the like, a through hole may be formed on the recess.

Furthermore, in the above-mentioned air blower for a refrigerator or the like, the through hole is preferably smaller in diameter than the fan rotation shaft and is located at a position below the tip end.

Therefore, whenever the downwardly-directed fan motor drops (for any reason), the tip end of the fan rotation shaft of the fan motor contacts the bottom plate portion of the fan cover, which is opposed to the tip end, and a gap is formed between the fan and the inner face of the fan cover. Consequently, the rotating fan does not contact the inner face of the fan cover.

The nature, utility and principle of the invention will be more clearly understood from the following detailed description and the appended claims when read in conjunction with the accompanying drawings.

BRIEF DESCRIPTION OF THE DRAWINGS

FIG. 1 is a schematic longitudinal section view of a refrigerator or the like;

DETAILED DESCRIPTION OF THE PREFERRED EMBODIMENTS

Figure 1:
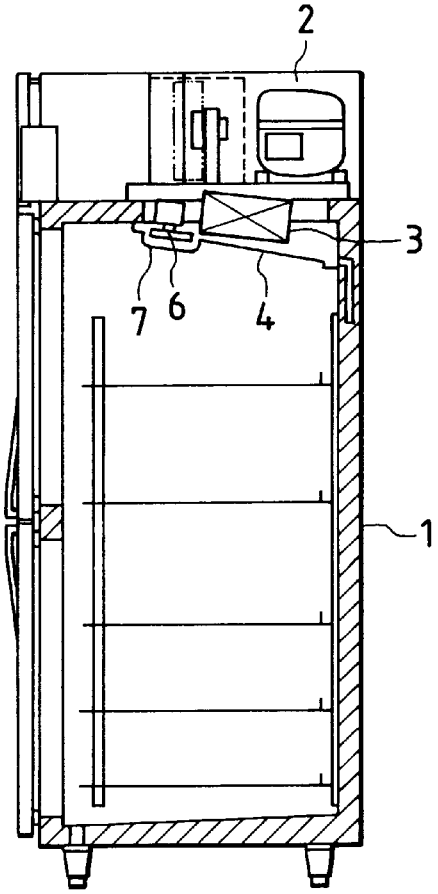
Figure 2:
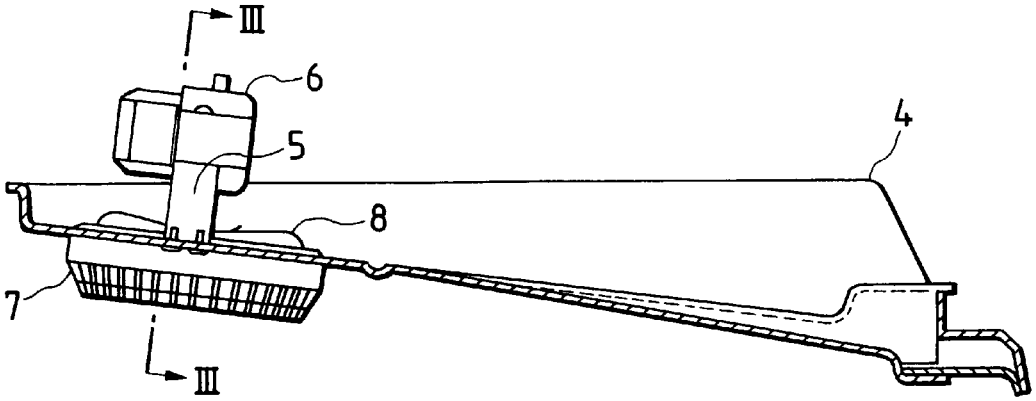
FIG. 2 is a side view showing main portions of an air blower of the prior art.
Figure 3:
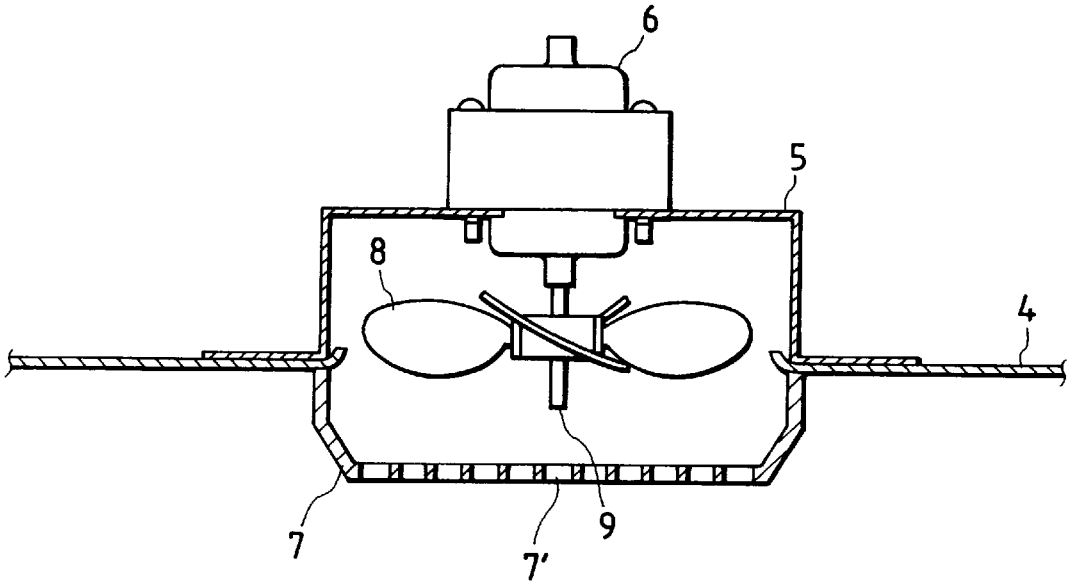
FIG. 3 is an enlarged longitudinal section view taken along the line III—III in FIG. 2.
Figure 4:
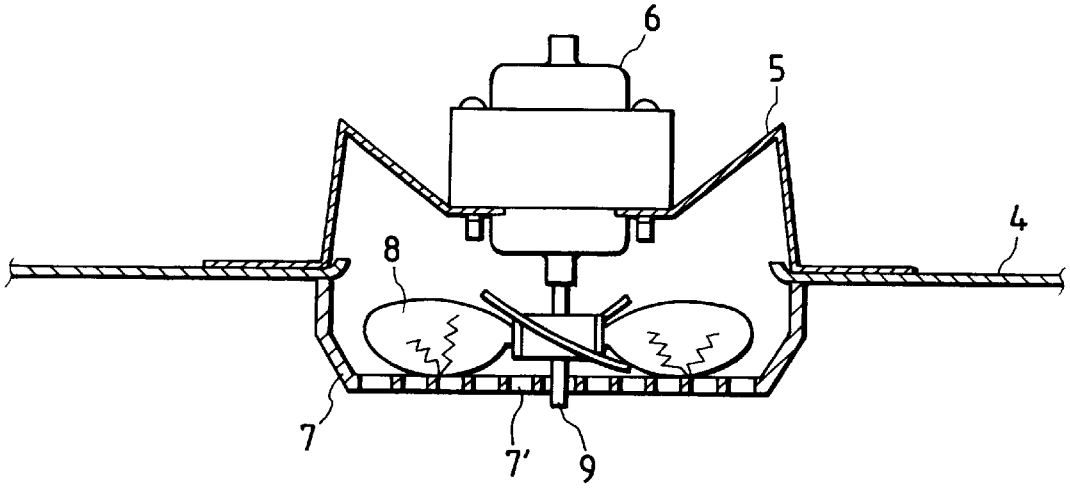
FIG. 4 is a diagram illustrating the operation of the air blower of the prior art.

Hereinafter, an embodiment of the invention will be described. Components which are equivalent to those of the prior art example are designated by the same reference numerals.

Figure 5:
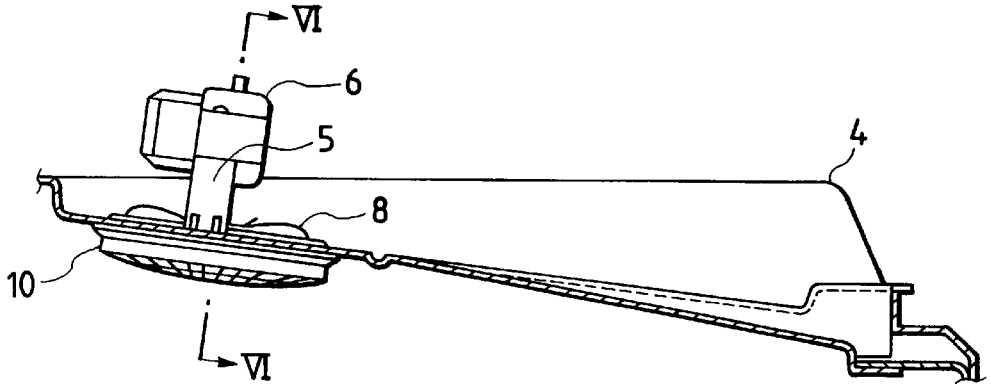
FIG. 5 is a side view showing main portions of an embodiment of the invention.
Figure 6:
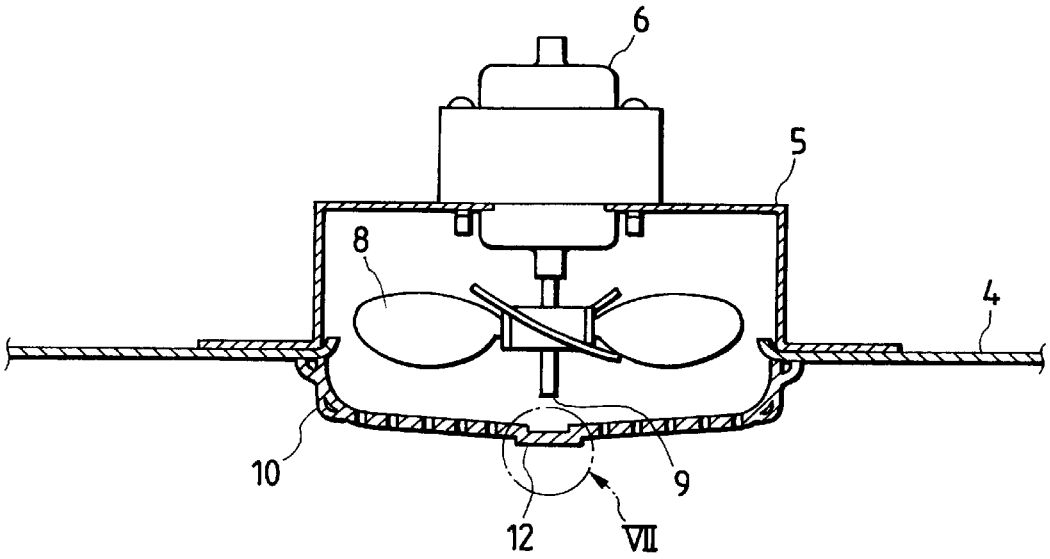
FIG. 6 is an enlarged longitudinal section view taken along the line VI—VI in FIG. 5.
Figure 7:
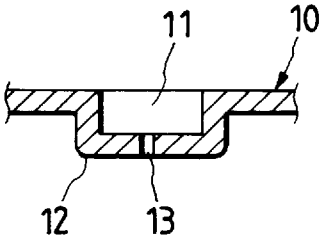
FIG. 7 is an enlarged view of the portion VII of FIG. 6.

Referring to FIGS. 5 to 7, an attaching plate 5 is fixed to a cooling air duct 4 disposed in an upper portion of the main unit of a refrigerator, a freezer, or the like. A fan motor 6 is downwardly directed and is attached to the attaching plate 5. Cooling air is supplied into the main unit by a fan 8 of the fan motor 6.

The fan motor 6 has a tip end 9 of a fan rotation shaft, which is downwardly projected from the fan 8. A grill-like fan cover 10 is attached to the cooling air duct 4 and below the fan motor 6. A bottom plate portion 12 is disposed at a center area of a fan cover 10, which is opposed to the tip end 9 of the fan rotation shaft and placed below the tip end. A recess 11 is formed in the bottom plate portion 12 and in the vicinity of the tip end 9 of the fan rotation shaft. A small hole 13 is formed in the bottom plate portion 12.

Figure 8:
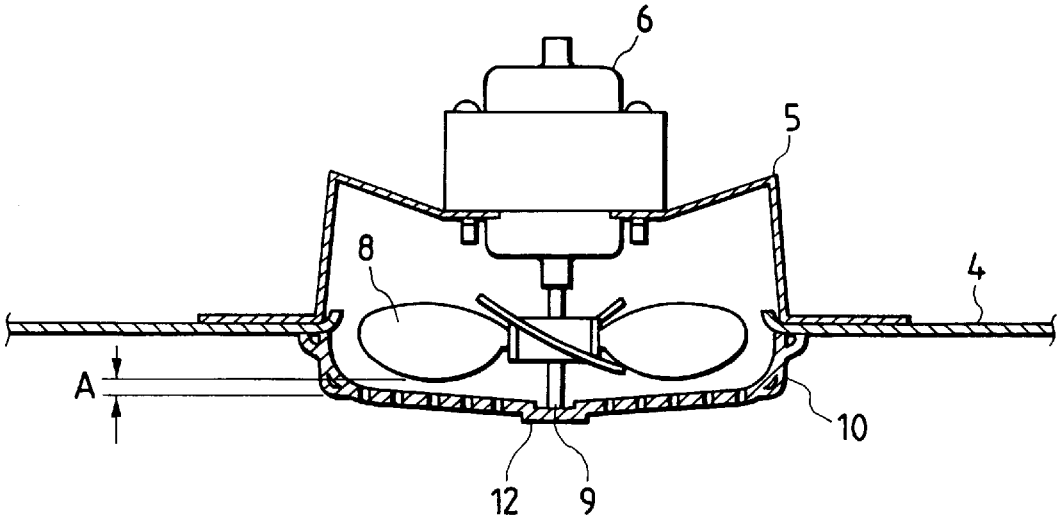
FIG. 8 is a diagram illustrating the operation of the embodiment.

When the fan motor 6 is used for a long time, the attaching plate 5 may become deformed by vibrations and the like, as shown in FIG. 8. This causes the fan motor 6 to drop from the original attachment position. When this happens, the tip end 9 of the fan rotation shaft first is fitted into the recess 11 to abut against the bottom plate portion 12. Thus, a gap A exists between the fan 8 and the inner face of the fan cover 10. The tip end 9 of the fan rotation shaft, which has been once fitted into the recess 11, escapes from the recess 11. Therefore, it is possible to prevent the fan 8 from contacting the inner face of the fan cover 10.

Consequently, unlike the air blower of the prior art, the damage to the fan 8, the fan cover 10, and the fan motor 6 are completely eliminated. The maintenance of the fan motor 6 and the fan cover 10 also are easily conducted. Moreover, the fan cover 10 does not have to have a deep portion in consideration of the above-mentioned drop of the fan motor 6. Therefore, the fan cover 10 can be formed so as to be relatively shallow. This produces an excellent improvement in the appearance of the interior of the main unit. The storage capacity of the top portion of the main unit is extensively increased in accordance with the reduction of the local projection from the ceiling of the main body, whereby the effective storage capacity of the interior of the main body can be easily increased.

Since the small hole 13 is formed in the bottom plate portion 12, water drops do not collect in the recess 11 of the bottom plate portion 12 during a defrosting operation. Therefore, no water drops collect and freeze around the fitting of the tip end 9 of the fan rotation shaft into the recess 11. Consequently, the invention further protects the fan 8 from being damaged.

In the air blower for a refrigerator or the like of the invention, even when the downwardly-directed fan motor drops for any reason and the tip end of the fan rotation shaft of the fan motor contacts the bottom plate portion of the fan cover which is opposed to the tip end, a gap is formed between the fan and the inner face of the fan cover, so that the rotating fan does not contact the inner face of the fan cover. Therefore, the fan and the fan cover are not damaged. Furthermore, since the projection of the fan cover into the main unit is reduced, the invention improves the appearance of the interior of the main unit, and increases the effective storage capacity of the interior of the main body.

While the invention has been described in connection with the preferred embodiment, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. An air blower for a refrigeration unit, comprising:

a fan;

a fan motor downwardly directed with a fan rotation shaft to which the fan is attached, a tip of the fan rotation shaft being projected downward with respect to the fan; and a fan cover attached below the fan motor, the fan cover being provided with a bottom plate portion formed at a position confronted with the tip of the fan rotation shaft to maintain a gap between the fan and an inner face of the fan cover by contacting with the tip of the fan rotation shaft when the fan motor drops, wherein a recess is defined by the bottom plate portion at a position opposed to the tip of the fan rotation shaft such that the tip of the fan rotation shaft is received into the recess when the fan motor drops.

2. The air blower for a refrigeration unit according to claim 1, wherein the bottom plate portion defines a through hole having a smaller diameter than a diameter of the fan rotation shaft.

3. The air blower for a refrigeration unit according to claim 2, wherein the through hole is located at a position below the tip of the fan rotation shaft.

4. An air blower for a refrigeration unit, comprising:

a rotatable shaft;

a plurality of fan blades mounted on the rotatable shaft to direct air in a downward direction, a tip of the rotatable shaft extending further downward than the plurality of fan blades;

a fan motor to drive the rotatable shaft and the plurality of fan blades;

an attaching plate portion to support the fan motor, the attaching plate being substantially horizontal and perpendicular to an axis of the rotatable shaft; and a fan cover disposed below the fan motor, the fan cover being provided with a bottom plate portion formed at a position confronted with the tip of the rotatable shaft to maintain a gap between the plurality of fan blades and an inner face of the fan cover by contacting with the tip of the fan rotation shaft when attaching plate portion deforms and the fan motor drops.

5. The air blower for a refrigeration unit according to claim 4, wherein a recess is defined by the bottom plate portion at a position opposed to the tip of the fan rotation shaft such that the tip of the fan rotation shaft is received into the recess when the fan motor drops.

6. The air blower for a refrigeration unit according to claim 5, wherein the bottom plate portion defines a through hole having a smaller diameter than a diameter of the fan rotation shaft.

7. The air blower for a refrigeration unit according to claim 6, wherein the through hole is located at a position below the tip of the fan rotation shaft.

8. The air blower for a refrigeration unit according to claim 4, wherein the bottom plate portion defines a through hole having a smaller diameter than a diameter of the fan rotation shaft.

9. The air blower for a refrigeration unit according to claim 6, wherein the through hole is located at a position below the tip of the fan rotation shaft.

* * * * *